US005348679A

United States Patent [19]

Weinhold et al.

[11] Patent Number: 5,348,679

[45] Date of Patent: Sep. 20, 1994

[54] AQUEOUS MULTIPURPOSE CLEANING COMPOSITION CONTAINING SULFITES AND GLYCOL ETHERS

[75] Inventors: Dennis G. Weinhold, Gilbert; Allen C. Hieatt, Mesa; Jerome H. Ludwig, Paradise Valley, all of Ariz.

[73] Assignee: h.e.r.c. Incorporated, Phoenix, Ariz.

[21] Appl. No.: 164,379

[22] Filed: Dec. 9, 1993

[51] Int. Cl.[5] ..... C11D 7/54; C11D 7/50; C11D 1/12; C11D 3/26; C23G 5/02

[52] U.S. Cl. ..... 252/105; 252/170; 252/171; 252/153; 252/546; 252/558

[58] Field of Search ..... 252/95, 94, 105, 539, 252/170, 173, 558, 174.18, 188.1, 188.21, 171, DIG. 14, 546, 153

[56] References Cited

U.S. PATENT DOCUMENTS

| | | | |
|---|---|---|---|
| 4,938,893 | 7/1990 | Copeland et al. | 252/527 |
| 4,943,392 | 7/1990 | Hastedt et al. | 252/539 |
| 5,004,558 | 4/1991 | Dyroff et al. | 252/95 |
| 5,104,951 | 4/1992 | Seelmann-Eggebert et al. | 526/240 |
| 5,116,388 | 5/1992 | Brooks | 8/405 |
| 5,158,710 | 10/1992 | VanEenam | 252/539 |
| 5,162,590 | 11/1992 | Fischer et al. | 568/622 |
| 5,190,699 | 3/1993 | Hohn et al. | 252/557 |

*Primary Examiner*—Paul Lieberman
*Assistant Examiner*—Lorna M. Douyon
*Attorney, Agent, or Firm*—Wood, Herron & Evans

[57] ABSTRACT

This invention relates to a multipurpose cleaner composition which has been found to be useful in a very broad range of cleaning applications when employed in various aqueous dilutions. The cleaning compositions of this invention have found utility in cleaning applications of low demand, such as cleaning of windows, to those of high demand, such as encrusted stoves or automotive engines and the like. Because the concentrated multipurpose cleaner is readily diluted, it can be marketed in a concentrated form and diluted by the user to the desired concentration for the particular cleaning job requirements, thus reducing the amount of cleaner packaging consumed by a household.

1 Claim, No Drawings

AQUEOUS MULTIPURPOSE CLEANING COMPOSITION CONTAINING SULFITES AND GLYCOL ETHERS

BACKGROUND OF THE INVENTION

There are many multipurpose cleaning compositions that are available commercially in both liquid and powder form for cleaning surfaces and fabrics such as glass, ceramic tile, linoleum, fiberglass, aluminum, stainless steel, porcelain, cement, formica and other plastics, wood, rugs, clothes, auto upholstery, and the like.

However, most multipurpose cleaning compositions are limited in their consumer acceptance due to various drawbacks when used in a variety of cleaning applications. For example, many of these cleaners will remove organic soils but have difficulty in removing inorganic soils, while others have abrasives which limit their use because of a tendency to scratch the surfaces being cleaned. Some cleaners work well on greasy soils such as soap scum or engine deposits but will not work on windows due to the residues left behind after application. Many multipurpose cleaning compositions are limited in their use because of a high acid content residues left behind after application. Many multipurpose cleaning compositions are limited in their use because of a high acid content (low pH) or a high base content (high pH) which can damage the surface or fabric being cleaned. Therefore, there has been a need to have a multipurpose cleaning composition which can have very broad utilities in cleaning all surfaces and fabrics of various soils and yet be essentially a neutral composition (pH of about 6 to 8).

SUMMARY OF THE INVENTION

This invention encompasses multipurpose cleaning compositions comprised of an inorganic detergent builder, a bleaching agent, a polyol ether, an organic detergent builder, a chelating agent, and an amphoteric surfactant. These components are in admixture with water and are present in amounts sufficient to provide an essentially neutral composition having a pH of about 6 to 8 with unusually broad cleaning capabilities in an unusually broad range of applications.

Specifically, the compositions are suitable for cleaning stains and soils of grease, oil, soot, food, dirt and rust on a surface of metal, rubber, concrete, fabric, tile, plastic, wood, leather, glass, stone and ceramic.

In general, the inorganic detergent builder is present from about 5% to about 20% by weight and the remaining components are each present from about 0.5% to about 5% by weight of the composition. More preferably, each remaining component is present from about 0.5% to about 1.5% by weight of the composition.

The particular combination and relative proportions of chemicals taught by this invention provide several advantages over existing multipurpose cleaner compositions. First, the inventive composition has outstanding cleaning capabilities in an unusually broad range of applications. While multipurpose cleaners typically perform poorly in several settings, this invention performs remarkably well across a wide variety of cleaning situations. Second, the composition of this invention has an essentially neutral pH of about 6 to 8, i.e., about 7.5, thereby allowing it to perform in the atypically broad range of applications without damaging the surfaces being cleaned. Furthermore, the composition made according to this invention is relatively concentrated and easily dilutable. Therefore, the user can expand the range of cleaning applications even further by diluting the composition to a given concentration.

DETAILED DESCRIPTION OF THE INVENTION

The particular chemicals and their combination in water result in a multipurpose cleaner with unusually broad cleaning capabilities in an unusually broad range of applications, which will be demonstrated by the examples which follow.

One essential component of the composition of this invention is the inorganic detergent builder such as sodium sulfite. Sodium sulfite is one of many compounds and combinations of compounds employed in cleaning compositions as detergent builders. Another essential component of the composition of this invention is a bleaching agent such as sodium meta bisulfate which is employed to oxidize dyes and inks which are usually found in various stains and soils. Other bleaching agents and combinations thereof, such as hydrogen peroxide, calcium and sodium hypochlorite, are well known and are described in the literature, but many of them have limitations in their use as multipurpose cleaners because of compatibility with other ingredients or because of shelf life.

Another essential component of the composition of this invention is a polyol ether such as mono-normal-butoxy propanol and mono-tertiary-butoxy propanol or mixtures thereof. These polyol ethers are two of numerous water soluble organic compounds which are employed in cleaning compositions as solvents for grease and scum and also function generally as penetrating agents for various soils. However, it is preferred to use a combination of mono-normal-butoxy propanol and mono-tertiary-butoxy propanol for a broad range of cleaning and penetrating actions required in a multipurpose cleaner as will be demonstrated in the following examples.

An organic detergent builder such as sodium xylene sulfonate is also required. However, any organic builder may be used which also has detergency as well as soil, scum and grease penetration capabilities which assist the other components of the composition of this invention to enhance their activities in a multipurpose cleaner.

Another essential component of the composition of this invention is a chelating or complexing agent such as the tetrasodium salt of ethylenediamine tetraacetic acid. This type of organic amine/carboxylic acid derivative is employed as a chelating or complexing agent for hard water metal ions such as calcium, magnesium, iron, and the like and is useful in preventing and dissolving water scale such as calcium and magnesium carbonate and iron oxide. It also functions as a detergent builder.

An amphoteric surfactant such as the monosodium salt of isodecyloxypropyliminodipropionic acid is required. While ionic, nonionic, and amphoteric surfactants all are employed in cleaning solutions for specific applications, the monosodium salt of isodecyloxypropyliminodipropionic acid was selected because it is an amphoteric surfactant. As an amphoteric surfactant, the component has a broad range of detergency, is compatible with the other ingredients of the composition and is stable and functional in the neutral environment of the composition of this invention.

The following examples demonstrate the preparation of suitable compositions as well as the effectiveness of the multipurpose cleaning compositions of this invention in a remarkably broad range of applications.

EXAMPLE 1

Preparation of the Multipurpose Concentrate

The following concentrated blend of the multipurpose cleaner composition is illustrative of the compositions of this invention and was prepared to demonstrate the unusually broad cleaning efficacies of the composition as demonstrated in the examples which follow. The ingredients were added to a 1000 ml. beaker which was magnetically stirred to dissolve and mix the components as they were added in the following order:

| | | |
|---|---|---|
| Water | 800 gms | (80%) |
| Sodium sulfite | 120 gms | (12%) |
| Sodium meta bisulfite | 9 gms | (0.9%) |
| Mono-n-butoxy propanol | 9 gms | (0.9%) |
| Mono-t-butoxy propanol | 9 gms | (0.9%) |
| 40% sodium xylene sulfonate | 9 gms | (0.9%) |
| 38% tetrasodium salt of ethylenediamine tetraacetic acid | 9 gms | (0.9%) |
| 35% monosodium salt of isodecyloxypropyliminodipropionic acid | 35 gms | (3.5%) |

The resulting solution was clear and had a pH of about 7.5.

EXAMPLE 2

Cleaning Test of the Multipurpose Cleaner Concentrate at a 1 to 1 Dilution

Five ounces of the concentrated multipurpose cleaner of Example 1 were diluted with five ounces of water and mixed in a spray bottle. The following stains, soils and residues were treated by spraying the cleaning solution on the dirty surface to be treated, allowing the cleaning solution to work for 3 to 5 minutes, brushing the surface with a bristle brush or scrubbing with a nonabrasive pad, wiping the surface with a cloth or paper towel and rinsing the surface with water. The results were:

| Dirty Surface | Results |
|---|---|
| Oven-grease, soot and encrusted food | Clean |
| Stove-grease and encrusted food | Clean |
| Grill-grease, soot and encrusted food | Clean |
| Stove hood vent-grease and soot | Clean |
| Whitewall tires-dirt and soil | Clean |

EXAMPLE 3

Cleaning Test of the Multipurpose Cleaner Concentrate at a 1 to 4 Dilution

Four ounces of the concentrated multipurpose cleaner of Example 1 were diluted with sixteen ounces of water in a spray bottle. The following stains, soils and residues were treated by spraying the cleaning solution on the dirty surface to be treated, allowing the cleaning solution to work for 3 to 5 minutes, brushing lightly with a bristle brush, wiping the surface with a cloth or paper towel and rinsing the surface with water. The following results were obtained:

| Dirty Surface | Results |
|---|---|
| Automotive engine-grease, oil, dirt | Clean |
| Concrete driveway-grease, oil, rust, soil | Clean |
| Towel cloth-grease, oil, dirt | Clean |
| Floor tile-scuff marks, grease, dirt | Clean |

EXAMPLE 4

Cleaning Test of the Multipurpose Cleaner Concentrate at a 1 to 8 Dilution

One ounce of the concentrated multipurpose cleaner of Example 1 was diluted with eight ounces of water and mixed in a spray bottle. The following stains and soils of grease, oil, soot, food, dirt, and rust were treated by spraying the cleaning solution on the dirty surface of metal, rubber, concrete, fabric, tile, plastic (including painted surfaces), wood, leather, glass, stone and ceramic to be treated, allowing the cleaning solution to work for 3 to 5 minutes, lightly brushing the surface with a toothbrush or equivalent, blotting the soiled area with a paper towel to remove the solubilized stain, soil or residue and rinsing thoroughly or washing the surface to remove the final residues. The following results were obtained:

| Stained or Soiled Surface | Results |
|---|---|
| Cotton pants-grass stain | Clean |
| Cotton fabric-iodine, blood, coffee stain, tea stain, cola stain, beet juice stain, cranberry juice stain, blueberry stain, cherry "Kool Aid" stain, lipstick, leather dye, red wine, ketchup, salsa, chocolate, grape juice stain, butter | Clean |
| Nylon rug-unknown dark soiled spot | Clean |
| White shirt-antiperspirant stain | Clean |
| Upholstered chair-unknown soil and dirt | Clean |

EXAMPLE 5

Cleaning Test of the Multipurpose Cleaner Concentrate at a 1 to 16 Dilution

One ounce of the concentrated multipurpose cleaner of Example 1 was diluted with sixteen ounces of water and mixed in a spray bottle. The following surfaces were treated with the solution by spraying and wiping clean with a cloth or paper towel. The grime on the surfaces was a result of handprints, water and soap stains, grease, soil dirt, food residues and the like:

| Soiled Surface | Results |
|---|---|
| Formica counter | Clean |
| Bathroom tile | Clean |
| Painted woodwork | Clean |
| Vinyl floor tile | Clean |
| Kitchen sink | Clean |
| Chrome fixtures | Clean |
| Painted wall | Clean |
| Light switch | Clean |
| Ceramic table light | Clean |

EXAMPLE 6

Cleaning Test of the Multipurpose Cleaner Concentrate at a 1 to 256 Dilution One ounce of the concentrated multipurpose cleaner of Example 1 was diluted with two gallons (256 ounces) of water, mixed and poured into a spray bottle. The following glass-like surfaces that were soiled with dirt, hand prints, water residues, bug residues, and the like were sprayed with the diluted multipurpose cleaner with the following results:

| Glass Surface | Results |
|---|---|
| Auto windshield | Clean, no streaks or residues |
| Glass door & tile | Clean, no streaks or residues |
| Refrigerator door | Clean, no streaks or residues |
| Mirror & counter top | Clean, no streaks or residues |

The invention is not limited to the examples discussed above, but on the contrary, is intended to cover various modifications and equivalent arrangements included within the spirit and scope of the appended claims.

What is claimed is:

1. A multipurpose cleaning composition comprising:

from about 5% to about 20% by weight of sodium sulfite;

from about 0.5% to about 1.5% by weight of sodium meta bisulfite;

from about 0.5% to about 1.5% by weight of mono-normal-butoxy propanol;

from about 0.5% to about 1.5% by weight of mono-tertiary-butoxy propanol;

from about 0.5% to about 1.5% by weight of sodium xylene sulfonate;

from about 0.5% to about 1.5% by weight of the tetrasodium salt of ethylene-diamine tetraacetic acid;

from about 2% to about 5% by weight of the mono-sodium salt of isodecyloxypropyliminodipropionic acid;

said components in admixture with water and present in said composition in amounts sufficient to provide an essentially neutral composition with broad cleaning capabilities for a broad range of surface applications.

* * * * *